US008651094B2

(12) United States Patent
Matasic et al.

(10) Patent No.: US 8,651,094 B2
(45) Date of Patent: Feb. 18, 2014

(54) BOW HAVING IMPROVED LIMBS, TRIGGER RELEASES, SAFETY MECHANISMS AND/OR DRY FIRE MECHANISMS

(75) Inventors: Charles S. Matasic, West Chester, PA (US); Baron E. Abel, Wrightsville, PA (US); Curvin L. Wolfgang, Jr., York, PA (US)

(73) Assignee: Kodabow Inc., West Chester, PA (US)

( * ) Notice: Subject to any disclaimer, the term of this patent is extended or adjusted under 35 U.S.C. 154(b) by 438 days.

(21) Appl. No.: 13/009,161

(22) Filed: Jan. 19, 2011

(65) Prior Publication Data

US 2011/0197869 A1 Aug. 18, 2011

Related U.S. Application Data

(60) Provisional application No. 61/296,105, filed on Jan. 19, 2010.

(51) Int. Cl.
*F41B 5/12* (2006.01)
*F41A 17/46* (2006.01)

(52) U.S. Cl.
CPC .. *F41B 5/12* (2013.01); *F41A 17/46* (2013.01)
USPC ..... 124/25; 124/23.1; 124/31; 124/40

(58) Field of Classification Search
CPC ..... F41B 5/12; F41A 17/46
USPC ..... 124/23.1, 25, 31, 40
See application file for complete search history.

(56) References Cited

U.S. PATENT DOCUMENTS 2,786,461 A * 3/1957 Pelsue, Jr. ..... 124/25
3,050,046 A * 8/1962 Love ..... 124/25
3,538,901 A * 11/1970 Switack ..... 124/25
4,002,236 A * 1/1977 Tolleson ..... 206/577
4,206,740 A * 6/1980 Lydon ..... 124/25
4,258,689 A 3/1981 Barnett
4,479,480 A 10/1984 Holt
4,505,182 A 3/1985 Sullivan
4,545,358 A 10/1985 Collins
4,662,345 A * 5/1987 Stephens ..... 124/25
4,693,228 A 9/1987 Simonds et al.
4,719,897 A 1/1988 Gaudreau
4,732,134 A * 3/1988 Waiser ..... 124/25
4,827,893 A * 5/1989 Nishioka ..... 124/25
4,827,894 A 5/1989 Schallberger
4,877,008 A 10/1989 Troubridge
4,908,970 A 3/1990 Bell
4,926,834 A * 5/1990 Chauvin ..... 124/25
4,942,861 A 7/1990 Bozek
4,947,822 A * 8/1990 Jones et al. ..... 124/41.1
5,025,771 A 6/1991 Hanson
5,062,406 A * 11/1991 Robertson ..... 124/25
5,085,200 A * 2/1992 Horton-Corcoran et al. ... 124/25
5,193,725 A 3/1993 Radocy
5,224,463 A 7/1993 Townsend (Continued)

*Primary Examiner* — Gene Kim
*Assistant Examiner* — Alexander Niconovich
(74) *Attorney, Agent, or Firm* — McCarter & English

(57) ABSTRACT

The present disclosure provides improved bows (e.g., crossbows and/or vertical bows). More particularly, the present disclosure provides advantageous bows having improved limbs, trigger releases, safety mechanisms and/or dry fire mechanisms. In exemplary embodiments, the present disclosure provides for systems and methods for fabricating bows (e.g., crossbows/vertical bows) having improved limbs (e.g., crossbow limbs), trigger releases, safety mechanisms and/or dry fire mechanisms, and wherein the bows provide increased arrow speed and/or more efficient release of stored energy.

19 Claims, 4 Drawing Sheets

(56) References Cited

U.S. PATENT DOCUMENTS

| | | | | |
|---|---|---|---|---|
| 5,233,172 | A | 8/1993 | Chadima, Jr. et al. | |
| 5,546,924 | A | 8/1996 | Todd | |
| 5,553,596 | A | 9/1996 | Bednar | |
| 5,596,976 | A | 1/1997 | Waiser | |
| 5,598,829 | A * | 2/1997 | Bednar | 124/25 |
| 5,649,520 | A | 7/1997 | Bednar | |
| 5,680,853 | A | 10/1997 | Clayton | |
| 5,749,348 | A * | 5/1998 | Oviedo-Reyes | 124/25 |
| 5,823,172 | A | 10/1998 | Suggitt | |
| 5,884,614 | A * | 3/1999 | Darlington et al. | 124/25 |
| 5,987,724 | A | 11/1999 | Kleman | |
| 6,095,128 | A | 8/2000 | Bednar | |
| 6,173,707 | B1 | 1/2001 | Howell et al. | |
| 6,205,990 | B1 | 3/2001 | Adkins | |
| 6,286,496 | B1 | 9/2001 | Bednar | |
| 6,390,294 | B1 | 5/2002 | Fiore, Jr. et al. | |
| 6,425,386 | B1 | 7/2002 | Adkins | |
| 6,571,785 | B1 | 6/2003 | Choma | |
| 6,672,299 | B2 | 1/2004 | Proctor | |
| 6,705,304 | B1 | 3/2004 | Pauluhn | |
| 6,718,962 | B2 | 4/2004 | Adcock | |
| 6,736,123 | B1 * | 5/2004 | Summers et al. | 124/25 |
| 6,799,566 | B1 | 10/2004 | Malucelli | |
| 6,802,304 | B1 | 10/2004 | Chang | |
| 6,820,606 | B1 | 11/2004 | Duffey | |
| 6,868,845 | B1 | 3/2005 | Moore | |
| 6,874,491 | B2 | 4/2005 | Bednar | |
| 6,874,492 | B1 | 4/2005 | Schavone | |
| 6,886,549 | B2 | 5/2005 | McPherson | |
| 6,990,970 | B1 | 1/2006 | Darlington | |
| 7,017,568 | B1 | 3/2006 | Smith | |
| 7,025,051 | B1 * | 4/2006 | Gallops, Jr. | 124/23.1 |
| 7,051,467 | B1 | 5/2006 | Huber | |
| 7,066,166 | B2 * | 6/2006 | Crites et al. | 124/25 |
| 7,100,590 | B2 * | 9/2006 | Chang | 124/25 |
| 7,174,884 | B2 * | 2/2007 | Kempf et al. | 124/25 |
| 7,281,534 | B2 * | 10/2007 | Bednar | 124/25 |
| 7,363,921 | B2 * | 4/2008 | Kempf | 124/25 |
| 7,588,022 | B2 * | 9/2009 | Chang | 124/25 |
| 7,753,041 | B2 * | 7/2010 | Ogawa | 124/25 |
| 7,770,567 | B1 * | 8/2010 | Yehle | 124/25 |
| 7,779,824 | B2 * | 8/2010 | Bednar | 124/25 |
| 7,810,480 | B2 * | 10/2010 | Shepley et al. | 124/25 |
| 7,823,572 | B2 * | 11/2010 | Anderson | 124/25 |
| 7,891,348 | B2 * | 2/2011 | Colley | 124/25 |
| 7,997,258 | B2 * | 8/2011 | Shepley et al. | 124/25 |
| 8,240,299 | B2 * | 8/2012 | Kronengold et al. | 124/25 |
| 2005/0011505 | A1 | 1/2005 | Nygaard et al. | |
| 2005/0072415 | A1 * | 4/2005 | Schavone | 124/31 |
| 2005/0279338 | A1 * | 12/2005 | Dziekan | 124/25 |
| 2006/0086346 | A1 * | 4/2006 | Middleton | 124/25 |
| 2008/0017177 | A1 * | 1/2008 | Pedemonte | 124/31 |
| 2008/0141989 | A1 * | 6/2008 | Ogawa | 124/25 |
| 2008/0251058 | A1 * | 10/2008 | Colley | 124/25 |
| 2009/0064978 | A1 * | 3/2009 | Matasic et al. | 124/35.1 |
| 2009/0078243 | A1 * | 3/2009 | Bednar et al. | 124/31 |
| 2009/0101126 | A1 * | 4/2009 | Anderson | 124/25 |
| 2009/0194086 | A1 * | 8/2009 | Kempf | 124/25 |
| 2010/0170486 | A1 * | 7/2010 | Shepley et al. | 124/25 |
| 2010/0170487 | A1 * | 7/2010 | Kronengold et al. | 124/25 |
| 2010/0170488 | A1 * | 7/2010 | Rasor et al. | 124/25 |
| 2010/0170489 | A1 * | 7/2010 | Shepley et al. | 124/25 |
| 2010/0224176 | A1 * | 9/2010 | Kaylan | 124/25 |
| 2011/0030666 | A1 * | 2/2011 | Darlington | 124/25 |
| 2012/0222661 | A1 * | 9/2012 | Bednar et al. | 124/25 |

* cited by examiner

BOW HAVING IMPROVED LIMBS, TRIGGER RELEASES, SAFETY MECHANISMS AND/OR DRY FIRE MECHANISMS

CROSS REFERENCE TO RELATED APPLICATIONS

This application claims the benefit of U.S. Provisional App. Ser. No. 61/296,105, filed Jan. 19, 2010, the entire contents of which is herein incorporated by reference in its entirety.

BACKGROUND

1. Technical Field

The present disclosure relates to bows (e.g., crossbows and/or vertical bows) and, more particularly, to crossbows/vertical bows having improved limbs, trigger releases, safety mechanisms and/or dry fire mechanisms.

2. Background Art

In general, bows (e.g., crossbows and/or vertical bows) are known. A constant need exists among these manufacturers to develop bows having increased arrow speed and more efficient release of stored energy. Moreover, a constant need exists to develop bows (e.g., crossbows and/or vertical bows) having improved limbs, trigger releases, safety mechanisms and/or dry fire mechanisms.

These and other inefficiencies and opportunities for improvement are addressed and/or overcome by the devices, systems and methods of the present disclosure.

SUMMARY

The present disclosure provides advantageous bows (e.g., crossbows and/or vertical bows). More particularly, the present disclosure provides improved bows having advantageous limbs, trigger releases, safety mechanisms and/or dry fire mechanisms. In exemplary embodiments, the present disclosure provides for systems and methods for fabricating bows (e.g., crossbows/vertical bows) having improved limbs (e.g., crossbow limbs), trigger releases, safety mechanisms and/or dry fire mechanisms, and wherein the bows provide increased arrow speed and/or more efficient release of stored energy.

The present disclosure provides for a bow system including at least two limbs, each limb: (i) defining an opening that substantially extends from a first end of each limb to a second end of each limb and (ii) having a limb tip at each second end; a string secured to each limb tip at a respective first and second end of the string; wherein when the string is drawn, each limb tip is configured and dimensioned to flex in a first direction so that when the string is released, the limb tips reverse the flex direction of the limb tips and accelerate the speed of the string thereby providing increased string speed and increased release of stored energy.

The present disclosure also provides for a bow system wherein the bow system is a cross-bow system or a vertical bow system. The present disclosure also provides for a bow system wherein the first and second end of the string is secured to its respective limb tip via a loop positioned at each first and second end of the string. The present disclosure also provides for a bow system wherein when the string is not drawn, at least a portion of the first and second ends of the string are positioned within or forward of at least a portion of the opening of each respective limb.

The present disclosure also provides for a bow system wherein when the string is released from the drawn position, at least a portion of the first and second ends of the string are allowed to pass through at least a portion of the opening of each respective limb, thereby substantially eliminating impact noise or vibration of the string against the limbs after the string is released. The present disclosure also provides for a bow system further including a dry fire prevention assembly. The present disclosure also provides for a bow system further including a safety assembly.

The present disclosure also provides for a bow system wherein the dry fire prevention assembly includes a movable member that is configured and adapted to interact with a string release member to block movement of the string release member, thereby blocking release of the drawn string unless the movable member is moved to a position out of the travel path of the string release member. The present disclosure also provides for a bow system wherein the movable member includes a surface that is configured and dimensioned to be moved when an arrow is inserted into the bow system and wherein the insertion of the arrow into the bow system moves the movable member to a position out of the travel path of the string release member.

The present disclosure also provides for a bow system wherein the dry fire prevention assembly includes an external member associated with the movable member that allows a user to move the movable member to a position out of the travel path of the string release member. The present disclosure also provides for a bow system wherein the safety assembly includes an external safety member that when moved provides for the movement of a rotating shaft that transfers rotary motion into linear motion at a safety slider member. The present disclosure also provides for a bow system wherein the safety slider member is configured and dimensioned to be moved between a safe and a fire position via rotation of the rotating shaft. The present disclosure also provides for a bow system wherein when the string is drawn, the drawn string causes the movement of a string release member and the safety slider member to the safe position.

The present disclosure also provides for a bow system wherein the safety assembly further includes a safety plunger that is configured and dimensioned to prevent movement of a trigger bar when the safety slider is in the safe position. The present disclosure also provides for a bow system wherein the safety plunger can only move when the safety slider is positioned in the fire position. The present disclosure also provides for a bow system wherein when the safety slider is positioned in the fire position, an opening in the safety slider is positioned above the safety plunger, thereby allowing the safety plunger to move directionally upwards within at least a portion of the opening, thereby permitting a first end of the trigger bar to rotate upwards with the safety plunger while the second end of the trigger bar rotates downwardly and allows a string release member to move freely.

The present disclosure also provides for a bow system wherein after the string release member is allowed to move freely, the drawn string may then be released via actuation of a trigger member. The present disclosure also provides for a bow system wherein actuation of the trigger member causes a cam surface of the trigger bar to move the string release member in order to release the string from the drawn position.

The present disclosure also provides for a bow system including at least two limbs, each limb: (i) defining an opening that substantially extends from a first end of each limb to a second end of each limb and (ii) having a limb tip at each second end; a string secured to each limb tip at a respective first and second end of the string; wherein when the string is not drawn, at least a portion of the first and second ends of the string are positioned within or forward of at least a portion of the opening of each respective limb; wherein when the string is drawn, the drawn string causes the movement of a string release member and the safety slider member to a safe position; and wherein when the string is released from the drawn position, at least a portion of the first and second ends of the string are allowed to pass through at least a portion of the opening of each respective limb, thereby substantially eliminating impact noise or vibration of the string against the limbs after the string is released.

The present disclosure also provides for a bow system including at least two limbs, each limb: (i) defining an opening that substantially extends from a first end of each limb to a second end of each limb and (ii) having a limb tip at each second end; a string secured to each limb tip at a respective first and second end of the string; a dry fire prevention assembly including a movable member that is configured and adapted to interact with a string release member to block movement of the string release member, thereby blocking release of the string when drawn, unless the movable member is moved to a position out of the travel path of the string release member; a safety assembly including an external safety member that when moved provides for the movement of a rotating shaft that transfers rotary motion into linear motion at a safety slider member, the safety slider member configured and dimensioned to be moved between a safe and a fire position via rotation of the rotating shaft; wherein the movable member includes a surface that is configured and dimensioned to be moved when an arrow is inserted into the bow system and wherein the insertion of the arrow into the bow system moves the movable member to a position out of the travel path of the string release member; wherein when the string is drawn, the drawn string causes the movement of the string release member and the safety slider member to the safe position; wherein the safety assembly further includes a safety plunger that is configured and dimensioned to prevent movement of a trigger bar when the safety slider is in the safe position; wherein the safety plunger can only move when the safety slider is positioned in the fire position by the safety lever and the rotating shaft; wherein when the safety slider is positioned in the fire position, an opening in the safety slider is positioned above the safety plunger, thereby allowing the safety plunger to move directionally upwards within at least a portion of the opening, thereby permitting a first end of the trigger bar to rotate upwards with the safety plunger while the second end of the trigger bar rotates downwardly and allows a string release member to move freely; and wherein after the string release member is allowed to move freely, actuation of a trigger member causes a cam surface of the trigger bar to move the string release member in order to release the string from the drawn position.

Additional advantageous features, functions and applications of the disclosed devices, systems and methods of the present disclosure will be apparent from the description which follows, particularly when read in conjunction with the appended figures.

BRIEF DESCRIPTION OF THE DRAWINGS

To assist those of ordinary skill in the art in making and using the disclosed devices, systems and methods, reference is made to the appended figures, wherein.

DETAILED DESCRIPTION

Figure 1:
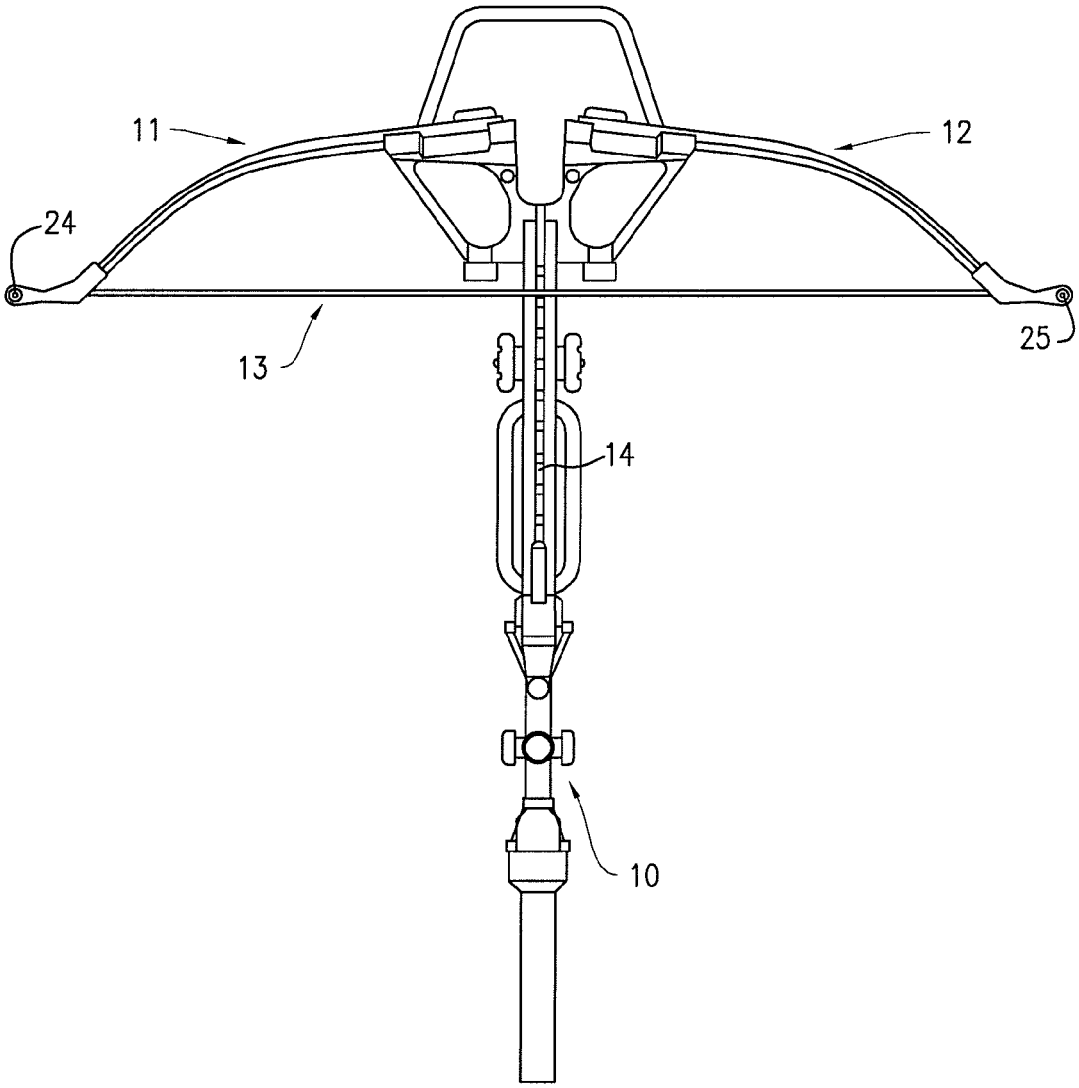
FIG. 1 is a top perspective view of a bow system according to an exemplary embodiment of the present disclosure.

In the description which follows, like parts are marked throughout the specification and drawings with the same reference numerals, respectively. Drawing figures are not necessarily to scale and in certain views, parts may have been exaggerated for purposes of clarity.

The present disclosure provides advantageous bows (e.g., crossbows and/or vertical bows). More particularly, the present disclosure provides improved bows having advantageous limbs (e.g., crossbow limbs), trigger releases, safety mechanisms and/or dry fire mechanisms. In exemplary embodiments, the present disclosure provides for systems and methods for fabricating bows (e.g., crossbows/vertical bows) having improved limbs, trigger releases, safety mechanisms and/or dry fire mechanisms, and wherein the bows provide increased arrow speed and/or more efficient release of stored energy.

Current practice provides that a constant need exists among bow manufacturers to develop bows having increased arrow speed and more efficient release of stored energy. Moreover, a constant need exists to develop bows (e.g., crossbows and/or vertical bows) having improved limbs, trigger releases, safety mechanisms and/or dry fire mechanisms. In exemplary embodiments, the present disclosure provides for improved devices, systems and methods for fabricating bows having improved limbs, trigger releases, safety mechanisms and/or dry fire mechanisms, and wherein the bows provide increased arrow speed and/or more efficient release of stored energy, thereby providing a significant manufacturing, commercial and/or operational advantage as a result.

Figure 2:
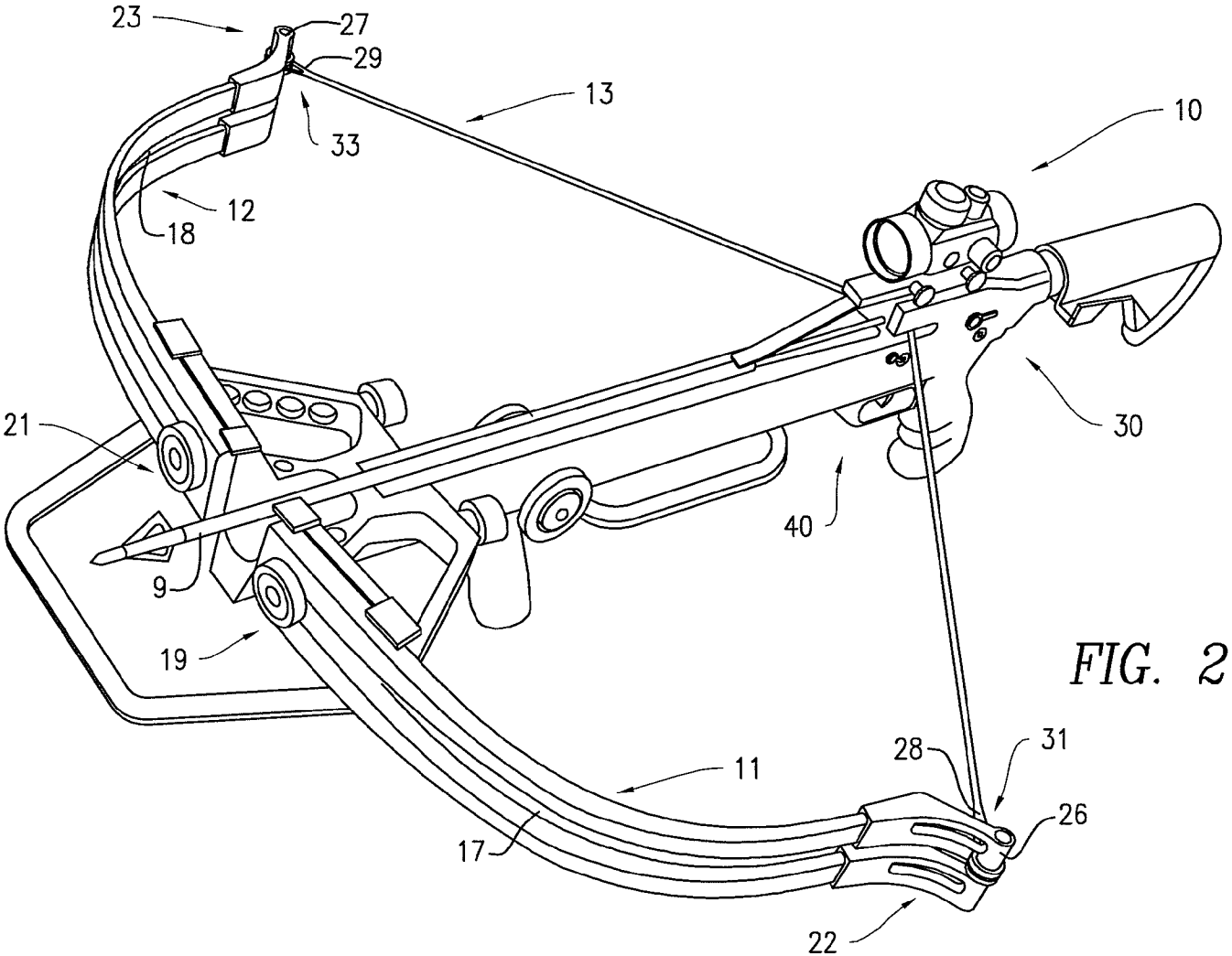
FIG. 2 is a side perspective view of a bow system according to an exemplary embodiment of the present disclosure.

Referring now to the drawings, and in particular to FIGS. 1-2, there is illustrated a bow system 10 depicting an embodiment of the present disclosure. For example, bow system 10 may be a crossbow or the like. In another embodiment, bow system 10 is a vertical bow. However, crossbows or vertical bows are not the only bow systems 10 that could be used in accordance with the principles of the present disclosure, as will be readily apparent to persons skilled in the art from the description provided herein.

In exemplary embodiments of the present disclosure, bow system 10 includes limbs 11, 12, and arrangements of a string 13 (e.g., bowstring) in relation to the limbs 11, 12, with various configurations/shapes of the limbs 11, 12 and various methods for connecting/attaching the string 13 to the limbs 11, 12.

In general, limbs 11, 12 are split into dual limbs for substantially their entire length or for a substantial portion of their total length, with each limb 11, 12 defining at least one respective opening or slit 17, 18 in each limb 11, 12 (FIG. 2). Stated another way, each respective opening or slit 17, 18 of limbs 11, 12 substantially extends from a first end 19, 21 of limbs 11, 12 to a second end 22, 23. Alternatively, bow system 10 may include only one limb 11 that defines one opening 17 that substantially extends from a first end 19 to a second end 22.

In exemplary embodiments of the present disclosure, dual or split limbs 11, 12 are joined at second ends or limb tip areas 22, 23 with or via a connecting/attaching device and/or limb tip 26, 27. In exemplary embodiments, connecting/attaching devices and/or limb tips 26, 27 are configured and dimensioned to secure each end of the string 13 to second ends 22, 23 of limbs 11, 12. For example, second ends or limb tip areas 22, 23 may each include an attachment, securing or connecting member (e.g., post member or the like) 24, 25, with each member 24, 25 configured and dimensioned to allow each end of the string 13 to be secured/attached to second ends 22, 23 of limbs 11, 12. In one embodiment, each end of string 13 includes a loop 28, 29 that is configured to attach, secure or connect to members 24, 25, although the present disclosure is not limited thereto. Various other attachment, connection and/or securement means may also be utilized to secure each end of the string 13 to second ends 22, 23 of limbs 11, 12 (e.g., fasteners, grips, pulleys, etc.).

One feature of the advantageous limb configuration is to allow a user to place the bowstring 13 in a position that, when not drawn (FIG. 1), at least a portion of the terminal ends 31, 33 of the bowstring 13 are forward of at least a portion of second ends 22, 23 and/or limbs 11, 12 as a result of the second ends or limb tip areas 22, 23 and openings/slits 17, 18 configurations. Stated another way, when not drawn, at least a portion of terminal ends 31, 33 of string 13 are positioned within and/or forward of at least a portion of openings 17, 18 of limbs 11, 12 (e.g., at or near second ends or limb tip areas 22, 23).

In exemplary embodiments of the present disclosure, when drawn (FIG. 2), the limb tip areas 22, 23 (and/or limbs 11, 12) flex or bend inwardly (e.g., in an angular manner) towards the main body 14 of the bow system 10. In this way, when the bowstring 13 is released from full draw (FIG. 2) and from fully or partially flexed limbs 11, 12 and/or limb tip areas 22, 23, the limbs 11, 12 and/or limb tip areas 22, 23 reverse the direction of the flexed or bent limbs 11, 12 and/or limb tip areas 22, 23 and accelerate the speed of the bowstring 13 (and arrow 9), thereby providing increased arrow speed and more efficient release of stored energy as a result of the increased flex or bend of the flexed limbs 11, 12 and/or limb tip areas 22, 23 (i.e., due at least in part to the configurations of at least a portion of terminal ends 31, 33 of string 13 being positioned within and/or forward of at least a portion of openings 17, 18 of limbs 11, 12 when string 13 is not drawn).

Moreover, bow system 10 also advantageously allows for substantially free moving and/or substantially unimpeded movement of at least a portion of bow string 13 (e.g., terminal ends 31, 33) forward through at least a portion of openings/slits 17, 18 of split limb assemblies 11, 12, thereby providing for increased travel of the bow string 13 in relation to limbs 11, 12 and/or ends 22, 23. In addition, as the string 13 travels forward, the split nature of the limbs 11, 12, allows the forward moving bowstring 13 to pass between at least a portion of limbs 11, 12, which thereby reduces or substantially eliminates impact noise and/or vibration of the bowstring 13 against the limbs 11, 12 that would occur with non-split limbs without openings/slits 17, 18, thereby providing users (e.g., hunters/sportsmen) with a significant operational advantage as a result.

Figure 3:
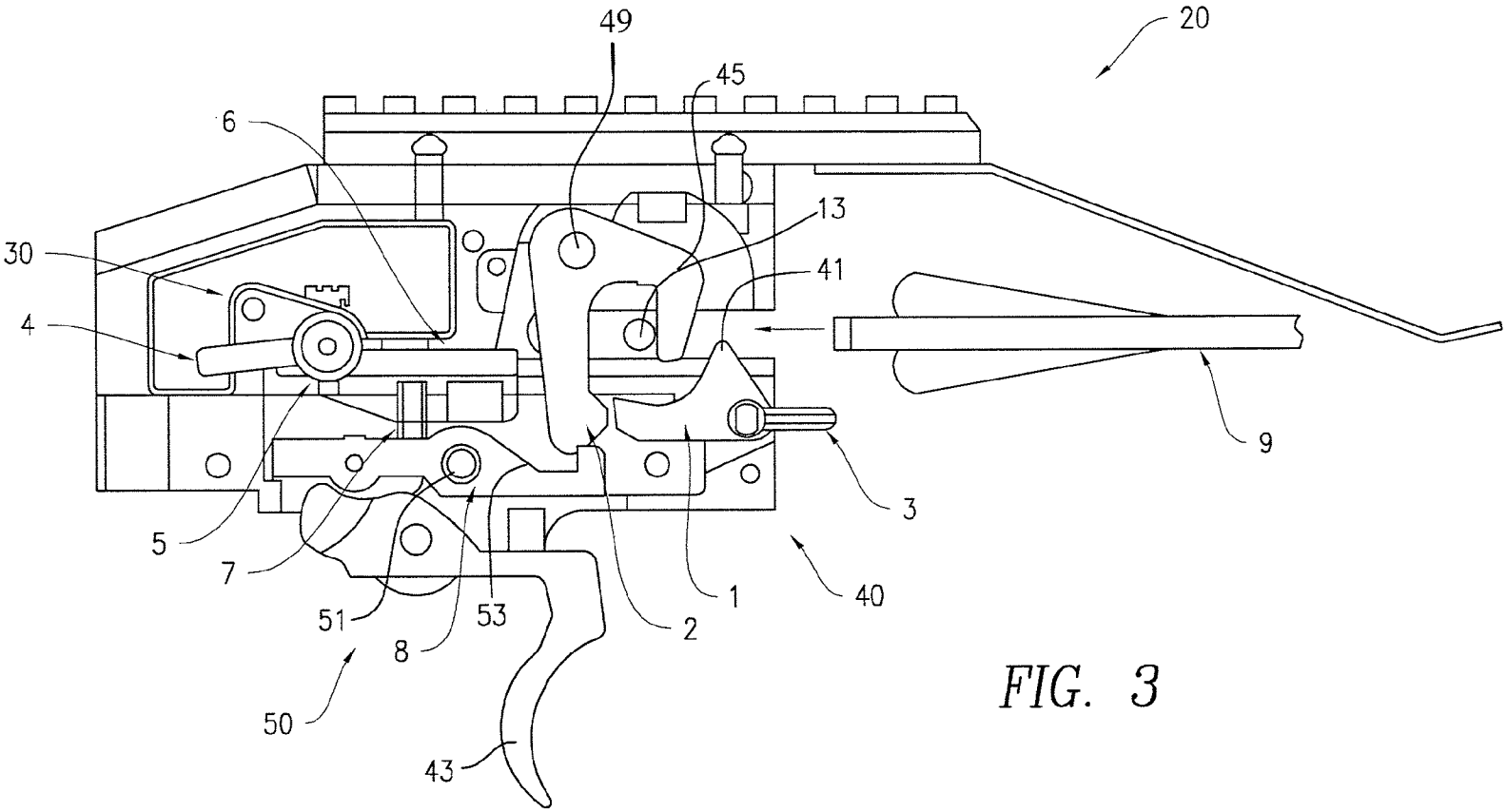
FIG. 3 is a partial cross-sectional side view of a trigger group or assembly of a bow system according to an exemplary embodiment of the present disclosure.

In exemplary embodiments of the present disclosure and as depicted in FIG. 3, the bow system 10 (e.g., crossbow or vertical bow) includes a trigger group or assembly 20 that includes: a safety mechanism or assembly 30, a dry fire prevention mechanism or assembly 40, and/or a trigger release mechanism or assembly 50.

In one embodiment, the dry fire mechanism or assembly 40 includes a surface 41 on a rotating lever or movable member 1 that is configured to be depressed or moved when an arrow 9 or the like is inserted in the bow system 10. In general, this rotating lever or movable member 1 interacts with a string release member 2, blocking forward movement (e.g., forward rotational movement via shaft 49) of the string release member 2, thereby blocking release of the bowstring 13 unless the rotating lever 1 is moved/positioned/rotated (e.g., downwardly) out of the travel path of the string release member 2 (e.g., via insertion of arrow 9 through an opening of upper claw-like portion 45 of string release member 2, or via lever 3 as discussed below) so that the trigger levers (discussed below) can complete the bow string release (e.g., via string release member 2).

In general, the dry fire mechanism or assembly 40 also includes an external lever or member 3 allowing the user to cause the same effect as if an arrow 9 is placed into the bow 10 (e.g., lever 3 is configured to move/position lever 1 downwardly out of the travel path of the string release member 2, so that the trigger levers can complete the bow string release). In this scenario, the user can release the bowstring 13 by pulling the trigger 43 without an arrow 9 in place for the purpose of de-cocking the bow by externally moving lever 3 to complete the firing circuit. In one embodiment, lever 3 is configured to be moved or positioned upwardly in order to move/position lever 1 downwardly out of the travel path of the string release member 2, so that the trigger levers can complete the bow string release. Alternatively, lever 3 may be configured/dimensioned to be moved/positioned in another direction (e.g., downwardly or upwardly depending on the orientation of the external lever 3) in order to move/position lever 1 downwardly out of the travel path of the string release member 2, so that the trigger levers can complete the bow string release.

In exemplary embodiments, the firing circuit or trigger group/assembly 20 is defined as the series of levers, members, linkages, pins and/or cams (e.g., safety assembly 30, dry fire prevention assembly 40 and/or trigger release assembly 50) that allows for the retention and release of the bowstring 13. In general, the dry fire mechanism/assembly 40 prevents the string release 2 from rotating forward (e.g., counter-clockwise) to release the string 13 without an arrow 9 in place or user action to depress/move lever 1 (e.g., via external lever 3).

Figure 4:
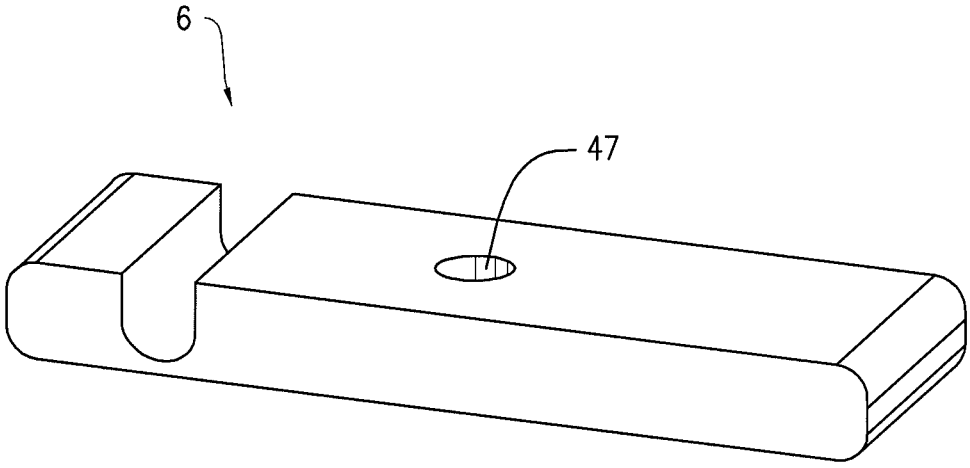
FIG. 4 is a perspective side view of an exemplary safety slider for use with a bow system according to an exemplary embodiment of the present disclosure.

In an exemplary embodiment, the safety mechanism or assembly 30 includes an external safety lever or member 4 that, when moved or actuated, provides for the movement (e.g., rotary movement) of a rotating shaft 5. In one embodiment, rotating shaft 5 includes an offset shaft on concentric circles that transfers rotary motion into linear motion at safety slider member 6 (FIGS. 3 and 4).

In exemplary embodiments, this occurs when rotating shaft 5 is rotated (e.g., via safety lever or member 4), thereby causing safety slider member 6 to achieve or move to either the "safe" position (FIG. 3), or the "fire" position. For example, the bowstring 13 can be released by completing the firing circuit when the user moves the main trigger 43 using finger pressure and the rotating shaft 5 is indexed or rotated (e.g., counter-clockwise in FIG. 3) to the "fire" position (e.g., by moving the safety lever or member 4 downwardly).

Additionally, when the bowstring 13 is pulled into the trigger group assembly 20 to cock the bow system 10, the string 13 causes the movement of the string release 2 and safety slider 6 to the rear of the trigger system, thereby causing shaft 5 to rotate (e.g., clockwise) and automatically set the safety and positions an external safety indicator lever 4, if provided, to the position marked as "safe" (FIG. 3).

In addition, safety is provided by a safety plunger 7 which acts as both the load for the trigger mechanism 43 spring and safety to prevent the movement of the trigger bar 8. In general, the plunger 7, when it is in the safe position (FIG. 3), will not allow travel/movement of the trigger bar 8 to activate the string release 2. This is accomplished by safety slider 6 stopping/preventing the movement of safety plunger 7. In general, the safety plunger 7 can only move when safety slider 6 is positioned in the fire position by safety lever 4 and rotating shaft 5. In one embodiment, this is accomplished by moving the safety lever 4 downwardly, which thereby rotates the shaft 5 counter-clockwise, which thereby moves the safety slider 6 linearly forward to cause a hole or opening or the like 47 (e.g., a concentric through-hole in safety slider 6) to move directly above the safety plunger 7, thereby allowing the plunger 7 to move directionally upwards within at least a portion of hole/opening 47. This permits rear end of trigger bar 8 to rotate upwards (e.g., via shaft 51) with plunger 7 while the opposite or forward end of trigger bar 8 rotates downwardly and releases/allows string release 2 to move freely. At this point (e.g., with plunger 7 positioned within at least a portion of hole/opening 47), bowstring 13 may be released from trigger group 20 when trigger 43 is actuated by a user, which causes trigger bar 8 (e.g., via cam surface 53) to move/rotate string release 2 to release bowstring 13. In exemplary embodiments, trigger 43 is associated with a shaft that allows for its rotational movement.

Although the systems and methods of the present disclosure have been described with reference to exemplary embodiments thereof, the present disclosure is not limited to such exemplary embodiments and/or implementations. Rather, the systems and methods of the present disclosure are susceptible to many implementations and applications, as will be readily apparent to persons skilled in the art from the disclosure hereof. The present disclosure expressly encompasses such modifications, enhancements and/or variations of the disclosed embodiments. Since many changes could be made in the above construction and many widely different embodiments of this disclosure could be made without departing from the scope thereof, it is intended that all matter contained in the drawings and specification shall be interpreted as illustrative and not in a limiting sense. Additional modifications, changes, and substitutions are intended in the foregoing disclosure. Accordingly, it is appropriate that the appended claims be construed broadly and in a manner consistent with the scope of the disclosure.

What is claimed is:

1. A bow system comprising:

at least two limbs, each limb: (i) defining an opening that substantially extends from a first end of each limb to a second end of each limb and (ii) having a limb tip at each second end;

a string that extends from a first terminal end to a second terminal end, the string secured to each limb tip at the respective first and second terminal ends of the string; wherein each limb tip includes a post member;

wherein the first and second terminal ends of the string are secured without the use of a cam to their respective limb tip post member to secure the terminal ends of the string to each respective limb tip;

wherein when the string is drawn, each limb tip is configured and dimensioned to flex in a first direction so that when the string is released, the limb tips reverse the flex direction of the limb tips and accelerate the speed of the string thereby providing increased string speed and increased release of stored energy; and wherein after the string is released from the drawn position, at least a portion of the forward moving first and second terminal ends of the string are allowed to forwardly pass through at least a portion of the opening of each respective limb, thereby substantially eliminating impact noise or vibration of the string against the limbs after the string is released.

2. The system of claim 1, wherein the bow system is a cross-bow system or a vertical bow system.

3. The system of claim 1, wherein the first and second terminal end of the string is secured to its respective limb tip via a loop positioned at each first and second terminal end of the string.

4. The system of claim 1, wherein when the string is not drawn, at least a portion of the first and second terminal ends of the string are positioned within or forward of at least a portion of the opening of each respective limb.

5. The system of claim 1, further comprising a dry fire prevention assembly.

6. The system of claim 1, further comprising a safety assembly.

7. The system of claim 5, wherein the dry fire prevention assembly includes a movable member that is configured and adapted to interact with a string release member to block movement of the string release member, thereby blocking release of the drawn string unless the movable member is moved to a position out of the travel path of the string release member.

8. The system of claim 7, wherein the movable member includes a surface that is configured and dimensioned to be moved when an arrow is inserted into the bow system and wherein the insertion of the arrow into the bow system moves the movable member to a position out of the travel path of the string release member.

9. The system of claim 5, wherein the dry fire prevention assembly includes an external member associated with the movable member that allows a user to move the movable member to a position out of the travel path of the string release member.

10. The system of claim 6, wherein the safety assembly includes an external safety member that when moved provides for the movement of a rotating shaft that transfers rotary motion into linear motion at a safety slider member; and further comprising a dry fire prevention assembly having a movable member that is configured and adapted to interact with a string release member to block movement of the string release member, thereby blocking release of the drawn string unless the movable member is moved to a position out of the travel path of the string release member;

wherein the movable member includes a surface that is configured and dimensioned to be moved when an arrow is inserted into the bow system and wherein the insertion of the arrow into the bow system moves the movable member to a position out of the travel path of the string release member, the movable member separated from and operably independent from the external safety member.

11. The system of claim 10, wherein the safety slider member is configured and dimensioned to be moved between a safe and a fire position via rotation of the rotating shaft.

12. The system of claim 11, wherein when the string is drawn, the drawn string causes the movement of the string release member and the safety slider member to the safe position.

13. The system of claim 11, wherein the safety assembly further includes a safety plunger that is configured and dimensioned to prevent movement of a trigger bar when the safety slider is in the safe position.

14. The system of claim 13, wherein the safety plunger can only move when the safety slider is positioned in the fire position.

15. The system of claim 14, wherein when the safety slider is positioned in the fire position, an aperture in the safety slider is positioned above the safety plunger, thereby allowing the safety plunger to move directionally upwards within and through the aperture, thereby permitting a first end of the trigger bar to rotate upwards with the safety plunger while the second end of the trigger bar rotates downwardly and allows the string release member to move freely.

16. The system of claim 15, wherein after the string release member is allowed to move freely, the drawn string may then be released via actuation of a trigger member.

17. The system of claim 16, wherein actuation of the trigger member causes a cam surface of the trigger bar to move the string release member in order to release the string from the drawn position.

18. A bow system comprising:

at least two limbs, each limb: (i) defining an opening that substantially extends from a first end of each limb to a second end of each limb and (ii) having a limb tip at each second end, each limb tip including a post member;

a string that extends from a first terminal end to a second terminal end, the string secured without the use of a cam to each limb tip at the respective first and second terminal ends of the string, the first and second terminal ends of the string secured to their respective limb tip post member to secure the terminal ends of the string to each respective limb tip;

wherein when the string is not drawn, at least a portion of the first and second terminal ends of the string are positioned within or forward of at least a portion of the opening of each respective limb;

wherein when the string is drawn, the drawn string causes the movement of a string release member and a safety slider member to a safe position;

wherein after the string is released from the drawn position, at least a portion of the forward moving first and second terminal ends of the string are allowed to forwardly pass through at least a portion of the opening of each respective limb, thereby substantially eliminating impact noise or vibration of the string against the limbs after the string is released.

19. A bow system comprising:

at least two limbs, each limb: (i) defining an opening that substantially extends from a first end of each limb to a second end of each limb and (ii) having a limb tip at each second end, each limb tip including a post member;

a string that extends from a first terminal end to a second terminal end, the string secured to each limb tip at the respective first and second terminal ends of the string, the first and second terminal ends of the string secured to their respective limb tip post member to secure the terminal ends of the string to each respective limb tip;

a dry fire prevention assembly including a movable member that is configured and adapted to interact with a string release member to block movement of the string release member, thereby blocking release of the string when drawn, unless the movable member is moved to a position out of the travel path of the string release member;

a safety assembly including an external safety member that when moved provides for the movement of a rotating shaft that transfers rotary motion into linear motion at a safety slider member, the safety slider member configured and dimensioned to be moved between a safe and a fire position via rotation of the rotating shaft;

wherein after the string is released from the drawn position, at least a portion of the forward moving first and second terminal ends of the string are allowed to forwardly pass through at least a portion of the opening of each respective limb, thereby substantially eliminating impact noise or vibration of the string against the limbs after the string is released;

wherein the movable member includes a surface that is configured and dimensioned to be moved when an arrow is inserted into the bow system and wherein the insertion of the arrow into the bow system moves the movable member to a position out of the travel path of the string release member, the movable member separated from and operably independent from the external safety member;

wherein when the string is drawn, the drawn string causes the movement of the string release member and the safety slider member to the safe position;

wherein the safety assembly further includes a safety plunger that is configured and dimensioned to prevent movement of a trigger bar when the safety slider is in the safe position;

wherein the safety plunger can only move when the safety slider is positioned in the fire position by the safety lever and the rotating shaft;

wherein when the safety slider is positioned in the fire position, an aperture in the safety slider is positioned above the safety plunger, thereby allowing the safety plunger to move directionally upwards within and through the aperture, thereby permitting a first end of the trigger bar to rotate upwards with the safety plunger while the second end of the trigger bar rotates downwardly and allows the string release member to move freely; and wherein after the string release member is allowed to move freely, actuation of a trigger member causes a cam surface of the trigger bar to move the string release member in order to release the string from the drawn position.

* * * * *